US008762195B1

(12) United States Patent
Martin et al.

(10) Patent No.: US 8,762,195 B1
(45) Date of Patent: Jun. 24, 2014

(54) DYNAMICALLY GENERATING PRICING INFORMATION FOR DIGITAL CONTENT

(75) Inventors: Geoffrey Martin, Overland Park, KS (US); Jonathan Kindred, Olathe, KS (US); Jennifer Kindred, legal representative, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 1043 days.

(21) Appl. No.: 12/342,927

(22) Filed: Dec. 23, 2008

(51) Int. Cl.
*G06Q 30/00* (2012.01)

(52) U.S. Cl.
USPC ..... 705/7.35

(58) Field of Classification Search
USPC ..... 705/7.35
See application file for complete search history.

(56) References Cited

U.S. PATENT DOCUMENTS 7,340,759 B1 * 3/2008 Rodriguez ..... 725/8
2002/0194251 A1 * 12/2002 Richter et al. ..... 709/105
2003/0232616 A1 * 12/2003 Gidron et al. ..... 455/406
2005/0174975 A1 * 8/2005 Mgrdechian et al. ..... 370/338
2008/0134045 A1 * 6/2008 Fridman et al. ..... 715/735
2008/0154798 A1 * 6/2008 Valz ..... 705/400
2009/0262136 A1 * 10/2009 Tischer et al. ..... 345/629

OTHER PUBLICATIONS

Nair, Harikesh, "Intertemporal Price Discrimination With Forward-Looking Consumers: Application to the US Market for Console Video-Games," Quant Market Econ (2007) 5:239-292.*

* cited by examiner

*Primary Examiner* — Nathan Erb

(57) ABSTRACT

A method, system, and medium are provided for dynamically generating pricing information for digital content. In exemplary aspects, the technology includes receiving a request for digital content from a mobile device. In addition, attributes associated with the mobile device and digital content are identified, and a purchase-prediction score associated with the mobile device and request for digital content is received. The purchase-prediction score is used to dynamically generate pricing information of the digital content. The purchase-prediction score is derived from values assigned to the attributes, the values quantifying a correlation between purchase trends and the attributes.

7 Claims, 6 Drawing Sheets

DYNAMICALLY GENERATING PRICING INFORMATION FOR DIGITAL CONTENT

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

In a first aspect of the invention, a set of computer-useable instructions provides a method of dynamically pricing digital content that is retrievable by a mobile device. The method includes receiving from the mobile device a request for the digital content and identifying one or more attributes, which might be associated either with a user of the mobile device or with the digital content. The method also includes receiving a purchase-prediction score (PPS) that is associated with the user, the PPS having been derived from the one or more attributes. Each of the one or more attributes is mapped to an attribute value. Furthermore, based on the PPS, pricing information of the digital content is dynamically generated and communicated to the mobile device.

In another aspect, a set of computer-useable instructions provides a method of determining a purchase-prediction score ("PPS") for generating pricing information associated with a given transaction. The method includes receiving a set of requests for digital content from a set of mobile devices. Each mobile device is associated with a user attribute, and the digital content is associated with a digital-content attribute. The method also includes, for each request, logging a purchase price that was applied to the digital content, wherein the purchase price is variable from a regular price to a discounted price. Furthermore, a correlation is determined between purchase trends and at least one of the user attribute and the digital content attribute. Based on the correlation, a purchase-prediction score for the given transaction is calculated.

In a further aspect, a set of computer-useable instructions provides a method of dynamically pricing digital content that is retrievable by a target mobile device. The method includes receiving requests for digital content from a set of mobile devices. Each mobile device is associated with a user attribute and the digital content is associated with a digital content attribute. The method also includes, for each request, logging a purchase price that was applied to the digital content, wherein the purchase price is variable from a regular price to a discounted price. Furthermore, the method includes determining a correlation between purchase trends and the user attribute and the digital content attribute, wherein determining a correlation comprises assigning a corresponding attribute value. Moreover, a request for targeted content is received from the target mobile device, wherein at the targeted digital content or the target mobile device is associated with attributes for which a correlation has been established. The method includes identifying the attributes for which a correlation has been established and referencing a PPS that is based on the corresponding attribute value of the attributes for which a correlation has been established. Based on the PPS, pricing information of the targeted digital content is dynamically generated and communicated to the target mobile device.

BRIEF DESCRIPTION OF THE SEVERAL VIEWS OF THE DRAWINGS

Illustrative embodiments of the present invention are described in detail below with reference to the attached drawing figures, wherein.

DETAILED DESCRIPTION

The subject matter of our technology is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different components of methods employed, the terms should not be interpreted as implying any particular order among or between various steps herein disclosed unless and except when the order of individual steps is explicitly described.

Embodiments of our technology may be embodied as, among other things: a method, system, or set of instructions embodied on one or more computer-readable media. Computer-readable media include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to information-delivery media, RAM, ROM, EEPROM, flash memory or other memory technology, CD-ROM, digital versatile discs ("DVD"), holographic media or other optical disc storage, magnetic cassettes, magnetic tape, magnetic disk storage, and other magnetic storage devices. These technologies can store data momentarily, temporarily, or permanently.

Embodiments of our technology relate to dynamically generating pricing information for digital content. In exemplary aspects, the technology includes receiving a request for digital content from a mobile device. In addition, attributes associated with the mobile device and digital content are identified, and a purchase-prediction score associated with the mobile device and request for digital content is received. The purchase-prediction score is used to dynamically generate pricing information of the digital content.

Figure 1:
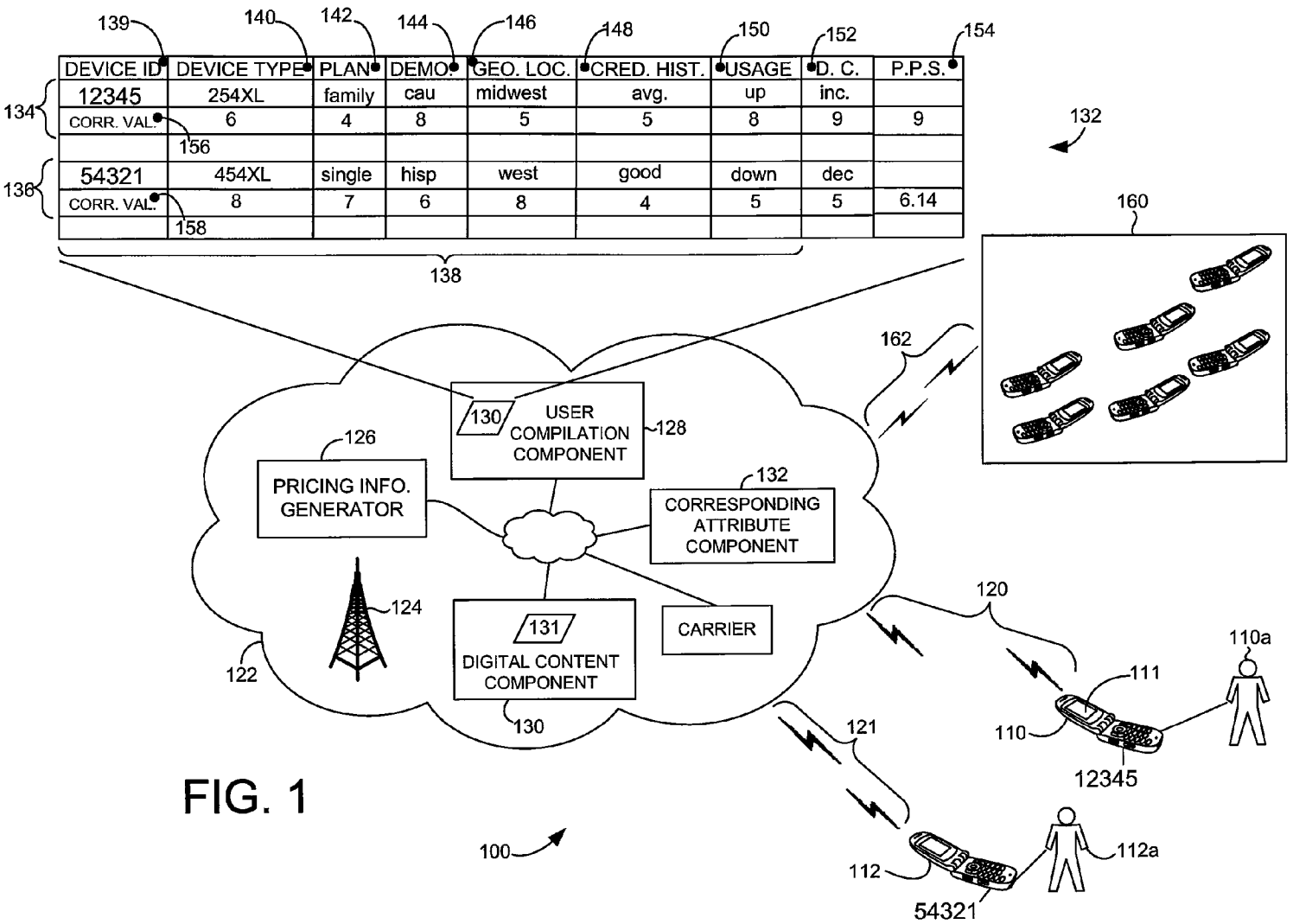
FIG. 1 depicts an illustrative operating environment suitable for practicing an embodiment of the present invention.

Turning now to FIG. 1, an illustrative operating environment suitable for practicing an embodiment of the technology is provided and referenced generally by the numeral 100. FIG. 1 shows mobile devices 110 and 112 and a plurality of mobile devices referenced generally by 160. Mobile devices might take on a variety of forms. For example, although mobile devices 110 and 112 are shown as mobile phones, mobile devices 110 and 112 might also include a PDA or other device that is capable of communicating with a communications network, such as network 122, by way of a communications link 120 and 121 (variously referred to herein as "wireless connectivity"). Mobile devices 110 and 112 may be utilized by one or more users, which are referred to as 110*a* and 112*a* respectively. Mobile device 110 includes a device identifier "12345" and mobile device 112 includes a device identifier "54321." Each device identifier corresponds to a "DEVICE ID" 139 in data compilation 132, which will be further described below.

Network 122 might variously be referred to herein as a communications carrier (or just "carrier"). Illustrative carriers include Sprint Nextel Corporation; Verizon Communications Inc.; AT&T Inc.; Qwest Communications International Inc.; Deutsche Telekom AG (ADR); Cricket Communications, Inc.; Leap Wireless International; and the like. Components of network 122 such as a base station or communications tower 124 can provide wireless connectivity 120 and 121 in some embodiments. Furthermore, carrier 122 includes other components, such as a pricing information generator 126, a digital content component 130, a user compilation component 128, and a corresponding attribute component 132. Each of these components might include one or more servers and one or more datastores.

By way of wireless connectivity 120 and 121, mobile devices 110 and 112 communicate with carrier 122. In an aspect of the technology, digital content component 130 includes digital content 131 that may be purchased by users 110*a* and 112*a* and downloaded to mobile devices 110 and 112. Digital content includes various types of content such as digital literature, digital music, digital video, digital audio, digital imagery, digital multimedia, and digital TV. Digital content component 130 might also include attribute data (e.g., measure of popularity of digital content) relating to digital content 131 and a regular price for digital content 131. A regular price for digital content might be any nondiscounted price set by network 122, and in one aspect, the regular price is the maximum price. Wireless connectivity 120 enables a browser 111 to display representations of digital content 131, which may be purchased from network 122. Moreover, wireless connectivity 120 enables mobile device 110 to send a request to network 122 to purchase digital content 131. In an embodiment of the technology, the request includes a variety of information such as device identifier 12345 and a digital content identifier associated with requested digital content 131. After receiving the request, components of the network 122, such as pricing information generator 126, digital content component 130, user compilation component 128, and user attribute component 132 process the request for digital content 131.

User compilation component 128 includes data 130, which includes data compilation 132. In an embodiment of the invention, data compilation 132 includes user compilations, which are related to a user of a mobile device, such as first user compilation 134 related to user 110*a* of mobile device 110 and second user compilation 136 related to user 112*a* of mobile device 112. As will be described in aspects of our technology, information in a user compilation 134 is used to generate pricing information for digital content.

Each user compilation includes a user profile 138, which includes a list of user attributes in one embodiment. User attributes are classified under user attribute categories, and in an embodiment of the invention, user attribute categories include device type 140, monthly plan 142, user demographics 144, user geographic location 146, user credit history 148, and recent usage patterns 150. User attributes might be stored separate from user compilation component 128 in one or more separate datastores within network 122. In one embodiment upon modification of a user attribute in a separate datastore, user compilation component 128 is dynamically updated by the separate datastore.

In embodiments of the invention, each user attribute category includes various user attributes, which include information related to a user of a mobile device and might be provided by a user, network 122, or a third party. For example, user attribute category "DEVICE TYPE" 140 includes the make and/or model of a mobile device associated with a user, and it might be the case that a user with a certain type of mobile device (e.g. mobile device "254XL") is more likely to purchase digital content at a discounted price than at a regular price. However, it may be the case that a user with a different mobile device (e.g., mobile device "454XL") is just as likely to purchase digital content at a discounted price as he or she is at a regular price. User attribute category "PLAN" 142 includes information relating to an agreement between a user and network 122 as to services that network 122 will provide and the user will pay for on a regular basis (e.g., family plan or single plan). User attribute category "DEMO" 144 relates to demographic information of a user (e.g., Caucasian or Hispanic). User attribute category "GEO. LOC." 146 includes information relating to a geographic location of the user (e.g., Midwest or Western U.S.). User attribute category "CRED. HIST." 148 includes information relating to credit details of a user and billing arrangements of a user (e.g. average, good, or automatic deposit). User attribute category "USAGE" 150 relates to recent usage patterns of a user (e.g., increase in amount of digital content purchased recently or decline in amount of digital content purchased recently).

A user compilation 134 might also include a digital content attribute category 152. Similar to user attributes, digital content attributes might also be used to generate pricing information. For example, "D.C." 152 includes digital content attributes relating to a piece of digital content, which was requested by a user. In one embodiment, the digital content attribute is a measure of current popularity or a measure of a recent popularity change of a piece of digital content. In aspects of the invention, where a piece of digital content has a high level of current popularity, network 122 might predict that a user is just as likely to purchase the piece of digital content at a regular price as he or she is at a discounted price. Likewise, where a piece of digital content has a low level of current popularity, network 122 might predict that a user is much more likely to purchase the piece of digital content at a discounted price as opposed to a regular price.

Each user compilation 134 also includes a corresponding attribute value associated with attributes. In an embodiment of the invention, a corresponding attribute value represents a quantified measure of inferences that an attribute might convey regarding a most appropriate price for digital content requested by a user with the attribute. In data compilation 132, corresponding attribute values of user compilation 134 are illustrated by line 156 and corresponding attribute values of user compilation 136 are illustrated by line 158. Determination of corresponding attribute values will be discussed in more detail below.

In a further aspect of the invention, each user compilation includes a purchase-prediction score ("PPS") 154 (e.g., the PPS for user compilation 134 is "9"). A PPS 154 might be used to determine pricing information for requested digital content. For example, a PPS might be used to indicate the likelihood that a user will purchase digital content at either a regular price or a reduced price. In another example, network 122 might set a regular price for digital content and then, based on a PPS, either apply the regular price or discount the regular price and apply the discounted price.

In an embodiment of the invention, for each user compilation, corresponding attribute values are used to determine a PPS 154. For example, corresponding attribute values of user attributes 140, 142, 144, 146, 148, and 150 might be used to determine a PPS. Also, corresponding values of digital content attributes 152 might be used to determine a PPS. Moreover, corresponding attribute values of both user attributes and digital content attributes might be used in combination to determine a PPS.

In one embodiment, corresponding attribute values are arithmetically combined to generate a PPS. For example, a mean value of corresponding attribute values might be calculated to determine a PPS. A PPS might alternatively be equal to a median value of corresponding attribute values. In another embodiment, predefined rules are applied to generate a PPS. For example, one predefined rule might state that the PPS for a user compilation is equal to the mean of all corresponding attribute values associated with the user compilation, unless one or more corresponding attribute values are greater than a specified value, in which case the PPS is equal to the corresponding attribute value that has the highest value. FIG. 1 illustrates application of such a predefined rule where the specified value is 8. With respect to user compilation 136, no corresponding attribute value is greater than 8; therefore, the PPS is equal to the average of all corresponding attribute values, i.e., "6.14" is the average of "8, 7, 6, 8, 4, 5, and 5." On the other hand, with respect to user compilation 134, the digital content 152 corresponding attribute value is "9" (which is greater than 8); therefore, the PPS for user compilation 134 is 9. An alternative predefined rule might state that the PPS for a user compilation is equal to the mean of all corresponding attribute values associated with the user compilation, unless one or more corresponding attribute values are less than a specified value, in which case the PPS is equal to the corresponding attribute value that has the lowest value.

Figure 2:
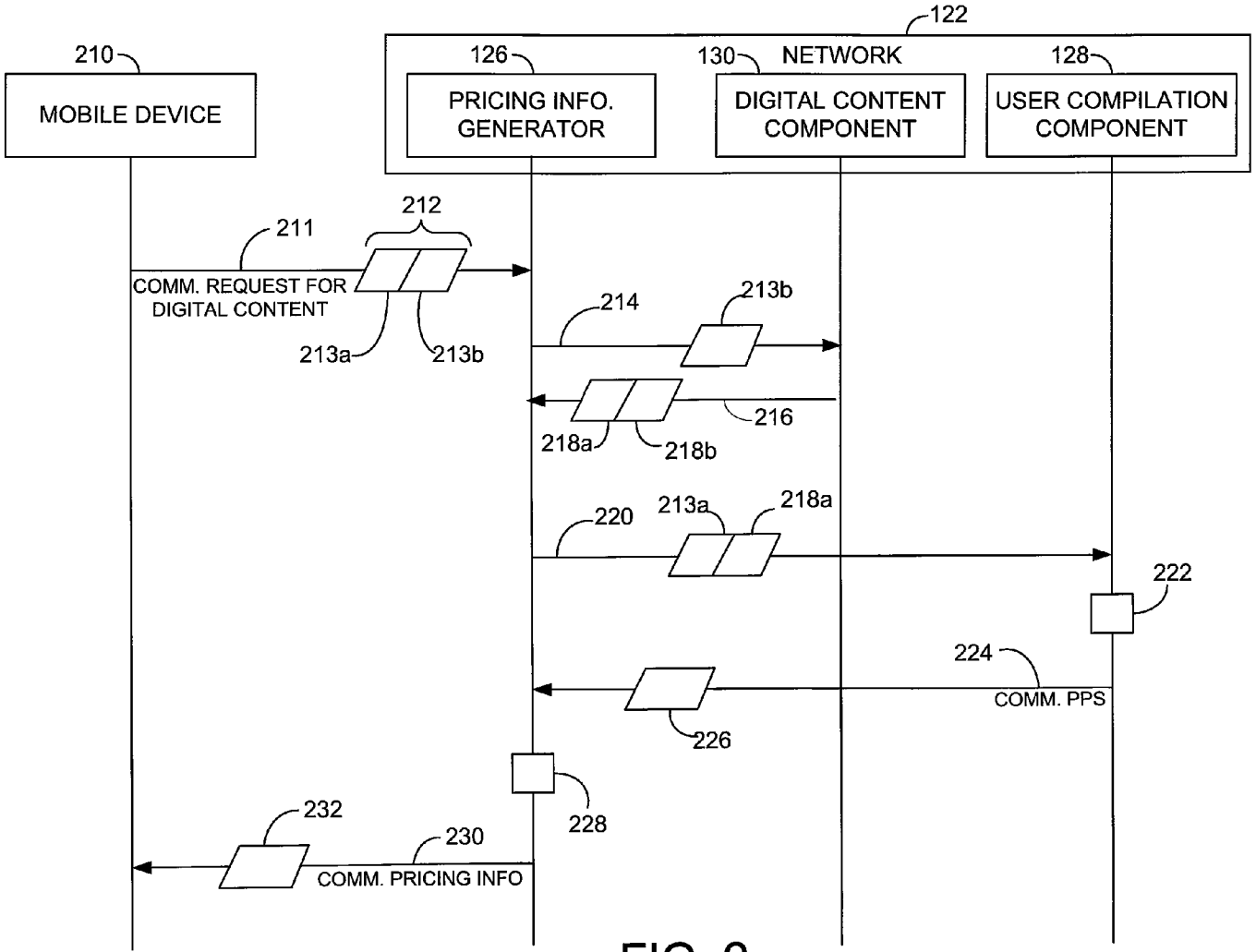
FIGS. 2 and 3 each depict a flow diagram of exemplary steps taken in aspects of the present invention.

In embodiments of the invention, a PPS associated with a user is used to determine pricing information for digital content requested by the user. Referring to FIG. 2, a mobile device 210 communicates 211*a* request 212 for digital content to the network 122. A request 212 might occur in a variety of contexts within interaction between mobile device 210 and network 122. In an embodiment, request 212 includes a request to preview a representation of digital content. In another embodiment, request 212 includes a request to purchase digital content. Request 212 might include a device identifier 213*a* associated with the mobile device 210 from which the request 212 is sent and a digital content identifier 213*b* associated with the requested digital content. Pricing information generator 126 within network 122 receives the request 212 for digital content and processes the request 212. Pricing information generator 126 references 214 digital content component 130 using digital content identifier 213*b*. Digital content component 130 communicates 216 corresponding attribute value 218*a* and regular price 218*b* associated with digital content requested by mobile device 210.

The pricing information generator 126 references 220 user compilation component 128 by communicating device identifier 213*a* and corresponding attribute value 218*a*. At 222 user compilation component 128 uses device identifier 213*a* to reference a user compilation associated with the mobile device 210 and populates the user compilation with corresponding attribute value 218*a*. User compilation component 128 applies predefined rules (as previously described) to generate a PPS for the user compilation. The generated PPS 226 is communicated 224 to the pricing information generator 126, such as by wireless connectivity.

At 228 pricing information generator 126 uses PPS 226 to dynamically generate pricing information. Pricing information may include an acquisition value, a choice of digital content version, a coupon, a bulk discount, etc. An acquisition value may include a purchase price for the digital content. In one embodiment, pricing information generator applies a set of predefined rules to determine at what price the digital content should be offered to the user for sale. Predefined rules might include a set of determinations. For example, if a determination is made that the PPS is equal to or above X, the pricing information generator might apply regular price 218*b*. If a determination is made that the PPS is equal to or above Y, but below X, a medium price may be applied. If a determination is made that the PPS is below Y, then a lowest price might be applied. In one embodiment, the medium price and lowest price are determined by applying a discount to the regular price. In another embodiment, pricing information generator 126 uses the PPS to reference a pricing guide, which includes various PPS values and a purchase price associated with each of the various PPS values. After dynamically generating pricing information, pricing information generator 126 communicates 230 pricing information 232 to mobile device 210.

Figure 3:
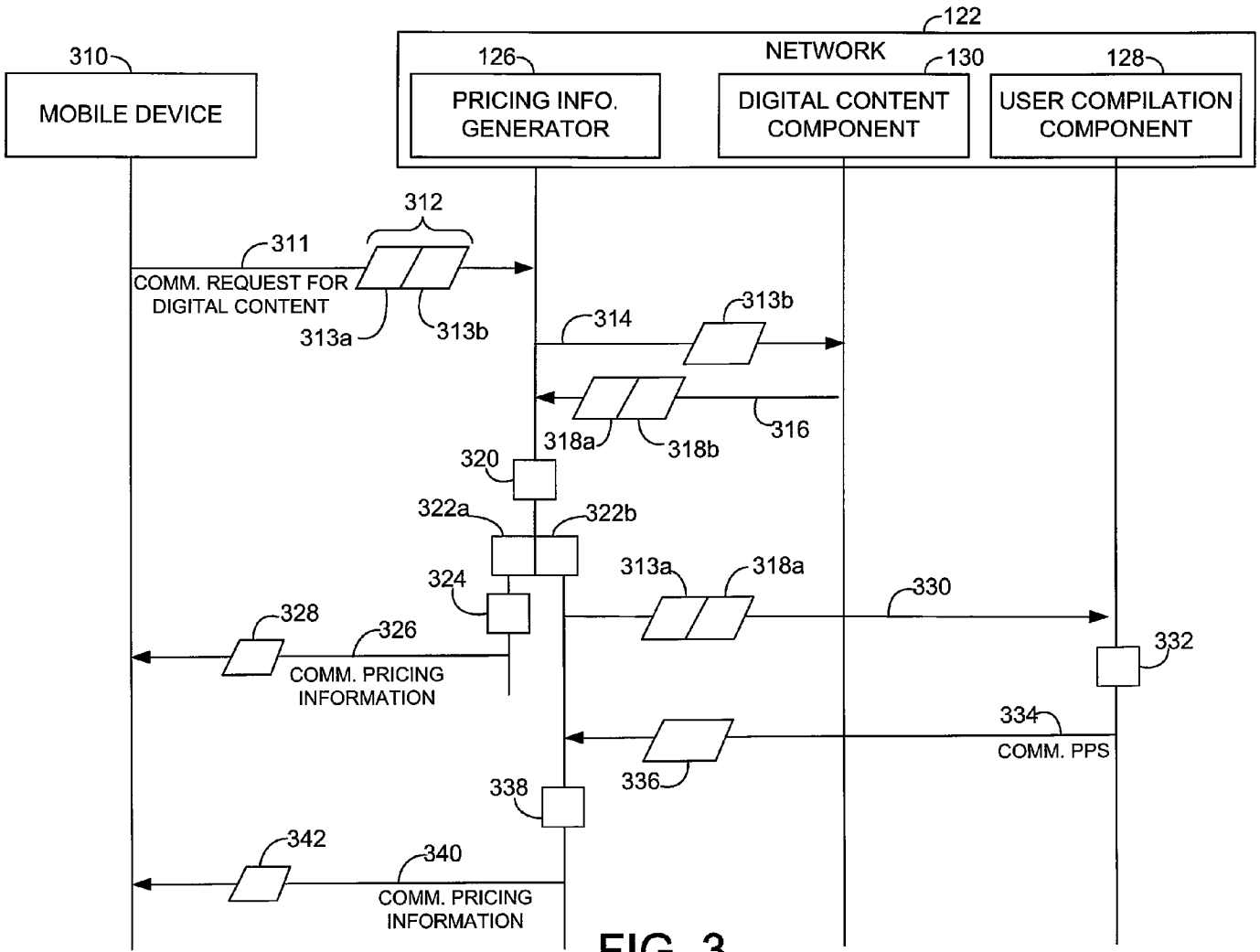

In an alternative embodiment of the technology, the pricing information generator 126 might generate pricing information without referencing the user compilation component 128, such as where a network has established that a strong correlation exists between the popularity (or lack of popularity) of requested digital content and a price at which a user is most likely to purchase the digital content. Referring to FIG. 3, mobile device 310 communicates 311*a* request 312 for digital content to network 122 and pricing information generator references 314 digital content component 130. At 316 corresponding attribute value 318*a*, which relates to a measure of popularity of requested digital content, and regular price 318*b* are sent to pricing information generator 126. At 320, pricing information generator 126 might apply predefined rules to determine if a PPS can be determined based on corresponding attribute value 318*a*. In one aspect, a predefined rule states that if the corresponding attribute value 318*a*, i.e., measure of popularity, is above a high specified value or below a low specified value, the PPS is equal to corresponding attribute value 318*a*. For example, the high specified value might be 8 and the low specified value might be 3, such that if corresponding attribute value 318*a* is equal to or above 9 or equal to or below 2, pricing information generator proceeds with establishing a PPS without referencing user compilation component 128. If pricing information generator 126 establishes a PPS, pricing information generator proceeds at 322*a* with dynamically generating pricing information. For example, at 324 pricing information generator 126 may apply predefined rules or reference a pricing guide to determine pricing information. At 326 pricing information generator 126 communicates pricing information 328 to mobile device 310. However, if pricing information generator 126 does not establish a PPS based on corresponding attribute value 318*a*, pricing information generator 126 proceeds at 322*b* with referencing the user compilation component. For example, similar to an embodiment outlined by FIG. 2, pricing information generator 126 might communicate 330 device identifier 313*a* and corresponding attribute value 318*a* to user compilation component 128. User compilation component 128 might then at 332 reference a user compilation associated with device 310, populate user compilation with corresponding user attribute 318*a*, and establish a PPS based on predefined rules. At 334 user compilation component 128 communicates the PPS 336 to pricing information generator 126. Pricing information generator might then dynamically generate pricing information at 338 by applying predefined rules or referencing a pricing guide. At 340 pricing information generator 126 communicates pricing information 342 to mobile device 310.

Another aspect of our technology relates to determining corresponding attribute values, such as those listed in line 156 of user compilation 134 and line 158 of user compilation 136. As previously described, corresponding attribute values might be used to establish a PPS for dynamically generating pricing information. Returning to FIG. 1, a plurality 160 of mobile devices may be in communication with network 122 by way of communication link 162, e.g., wireless connectivity. In addition, network 122 includes corresponding attribute component 132, which may include one or more servers and one or more databases. As previously described, components of network 122 allow the plurality of mobile devices 160 to communicate with the network 122. Accordingly, in an aspect of the invention the plurality of mobile devices 160 preview digital content provided by the network 122, communicate to network 122 a request to purchase digital content, and purchase digital content from the network 122.

In a further embodiment of the invention, corresponding attribute component 132 logs information relating to requests for digital content. For example, for each request for digital content from a mobile device, corresponding attribute component 132 might log user attributes, which are associated with the mobile device, and digital content attributes, which are associated with the digital content requested; price at which digital content was offered for purchase; and whether a sale resulted. Based on information logged over a period of time for various requests for digital content, corresponding attribute component 132 determines what price is most appropriate when specific user attributes and digital content attributes are associated with a request for digital content.

In one embodiment, digital content is offered for purchase at different prices to a plurality of users. Different prices might include a regular price for digital content and a range of discounted prices for digital content. For example, digital content might be offered for purchase at a lowest price for a period of time, during which corresponding attribute component 132 logs information relating to requests for digital content (e.g. attributes, price, sale result, etc). Digital content might also be offered for purchase at a second lowest price for a period of time, during which corresponding attribute component 132 logs information relating to requests for digital content. Digital content might also be offered for purchase at a third lowest price, during which corresponding attribute component 132 logs information relating to requests for digital content. Digital content might be offered at increasingly higher prices until the number of decisions to purchase includes a minimum threshold.

In one aspect, information logged is analyzed to determine what effect price increases or decreases have on users with an attribute in common. For example, users with only one attribute in common might be grouped and their purchase trends analyzed to determine if a strong or weak correlation exists between the common attribute and likelihood that a user associated with that common attribute will purchase digital content at a regular price or discounted price. It might be determined by comparing information logged that (a) users with a certain common attribute are more likely to purchase digital content at a second lowest price than at a third lowest price but that (b) those users are just as likely to purchase digital content at a second lowest price as at a lowest price. In another aspect, users with a set of attributes in common might be grouped to determine if a strong or weak correlation exists for the set of common attributes.

In one embodiment, based on a correlation for each attribute, corresponding attribute component 132 assigns a corresponding attribute value to each attribute. As previously described, in an aspect of the technology a corresponding attribute value represents a quantified measure of inferences that an attribute might convey regarding a most appropriate price for digital content requested by a user having the attribute. Corresponding attribute values might be assigned based on a range of values along a spectrum. In one aspect, where a correlation for an attribute indicates that a user with the attribute might be just as likely to purchase digital content at a regular price as the user would at a discounted price, the attribute is assigned a corresponding attribute value that is at one end of the spectrum. Furthermore, where a correlation for an alternative attribute indicates that a user having the alternative attribute might be more likely to purchase digital content at a lowest discounted price, the specific attribute might be assigned corresponding attribute value at the other end of the spectrum. In one embodiment, corresponding attribute component 132 continues to log information after corresponding attribute values have been established, thereby enabling corresponding attribute component 132 to verify accuracy of assigned corresponding attribute values and update corresponding attribute values as necessary.

Figure 5:
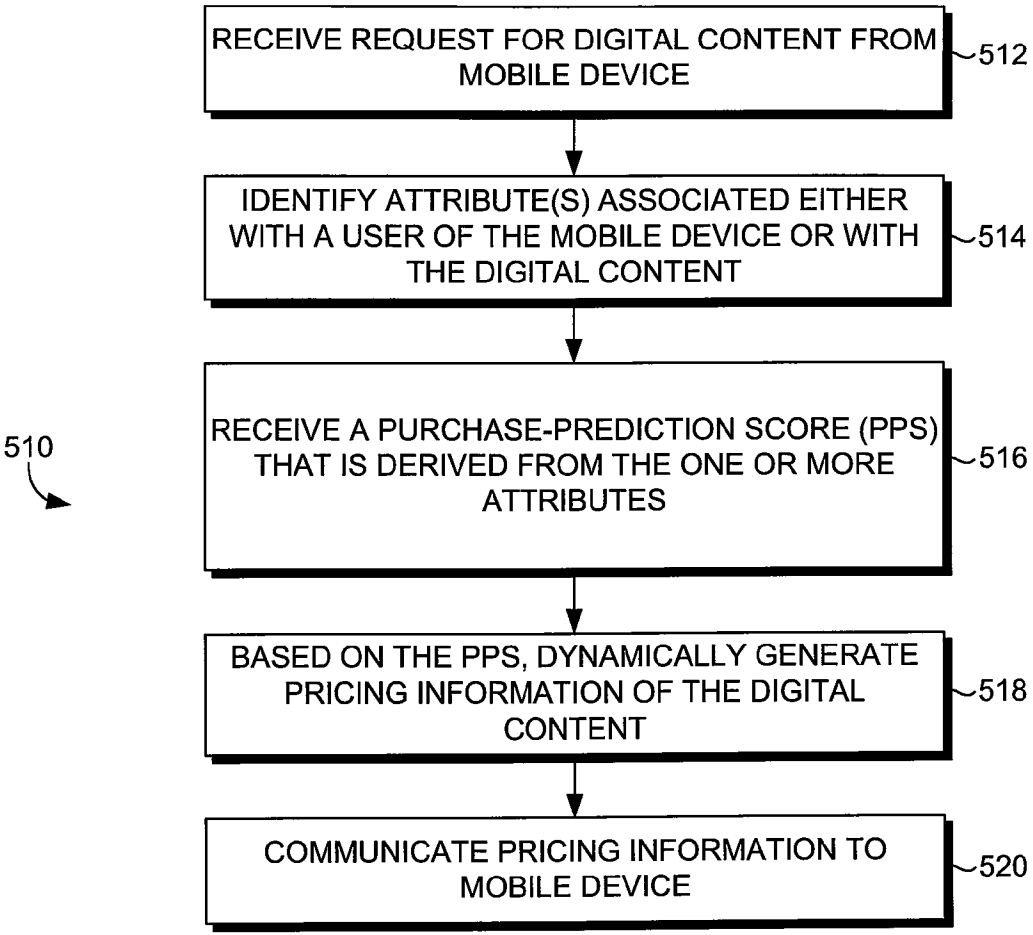

Referring to FIG. 5, in one embodiment, the technology includes one or more computer-readable media having computer-useable instructions embodied thereon for performing a method (identified generally by numeral 510) of dynamically pricing digital content that is retrievable by a mobile device. At step 512 the method includes receiving from the mobile device a request for the digital content, and step 514 includes identifying one or more attributes associated either with a user of the mobile device or with the digital content. Moreover, step 516 includes receiving a PPS that is associated with the user, the PPS having been derived from the one or more attributes, wherein each of the one or more attributes is mapped to an attribute value. Based on the PPS, at step 518 pricing information of the digital content is dynamically generated. Step 520 includes communicating the pricing information to the mobile device.

Figure 6:
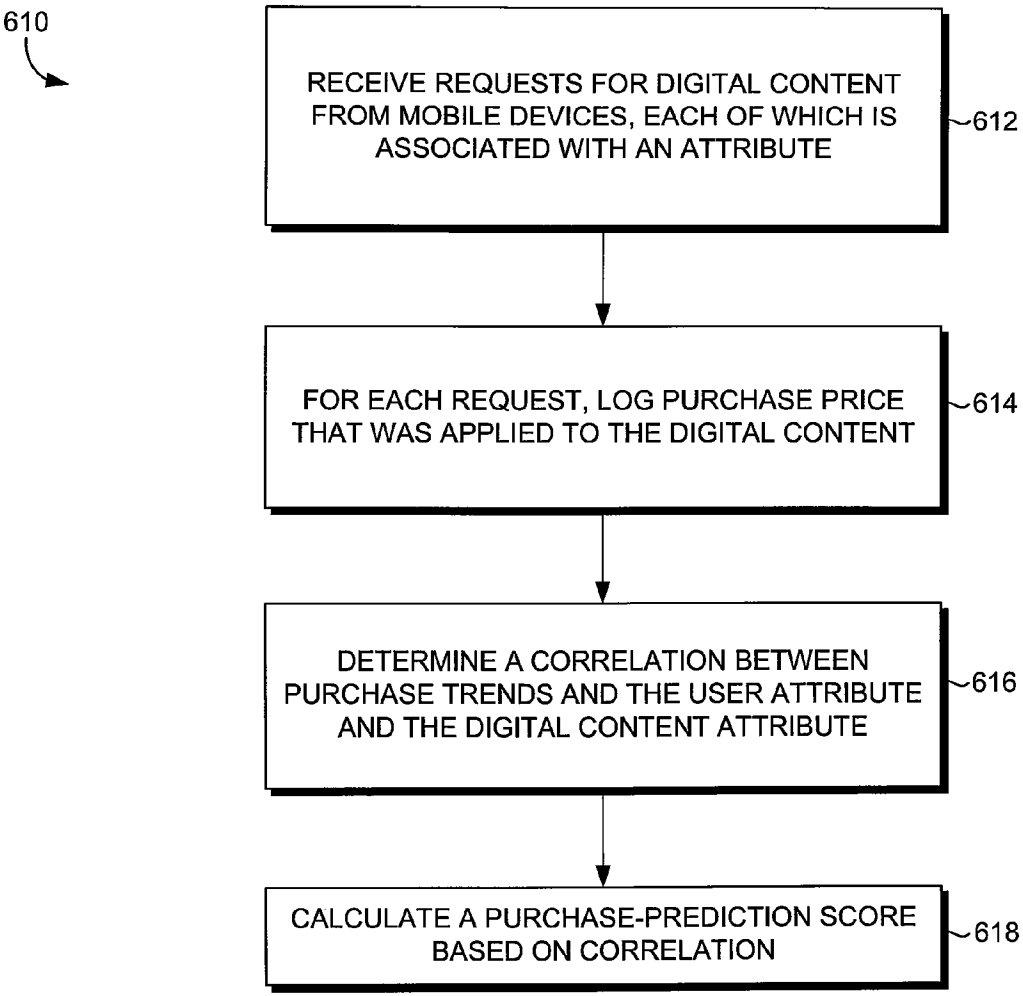

Referring to FIG. 6, in one embodiment, the technology includes one or more computer-readable media having computer-useable instructions embodied thereon for performing a method (referenced generally by numeral 610) of determining a purchase-prediction score for generating pricing information associated with a given transaction. At step 612 the method includes receiving requests for digital content from a number of mobile devices, wherein each mobile device is associated with a user attribute and wherein the digital content is associated with a digital content attribute. At step 614, for each request, a purchase price that was applied to the digital content is logged, wherein the purchase price is variable from a regular price to a discounted price. Step 616 includes determining a correlation between purchase trends and at least one of the user attribute and the digital content attribute. Based on the correlation, at step 618 a purchase-prediction score for the given transaction is calculated.

Figure 4:
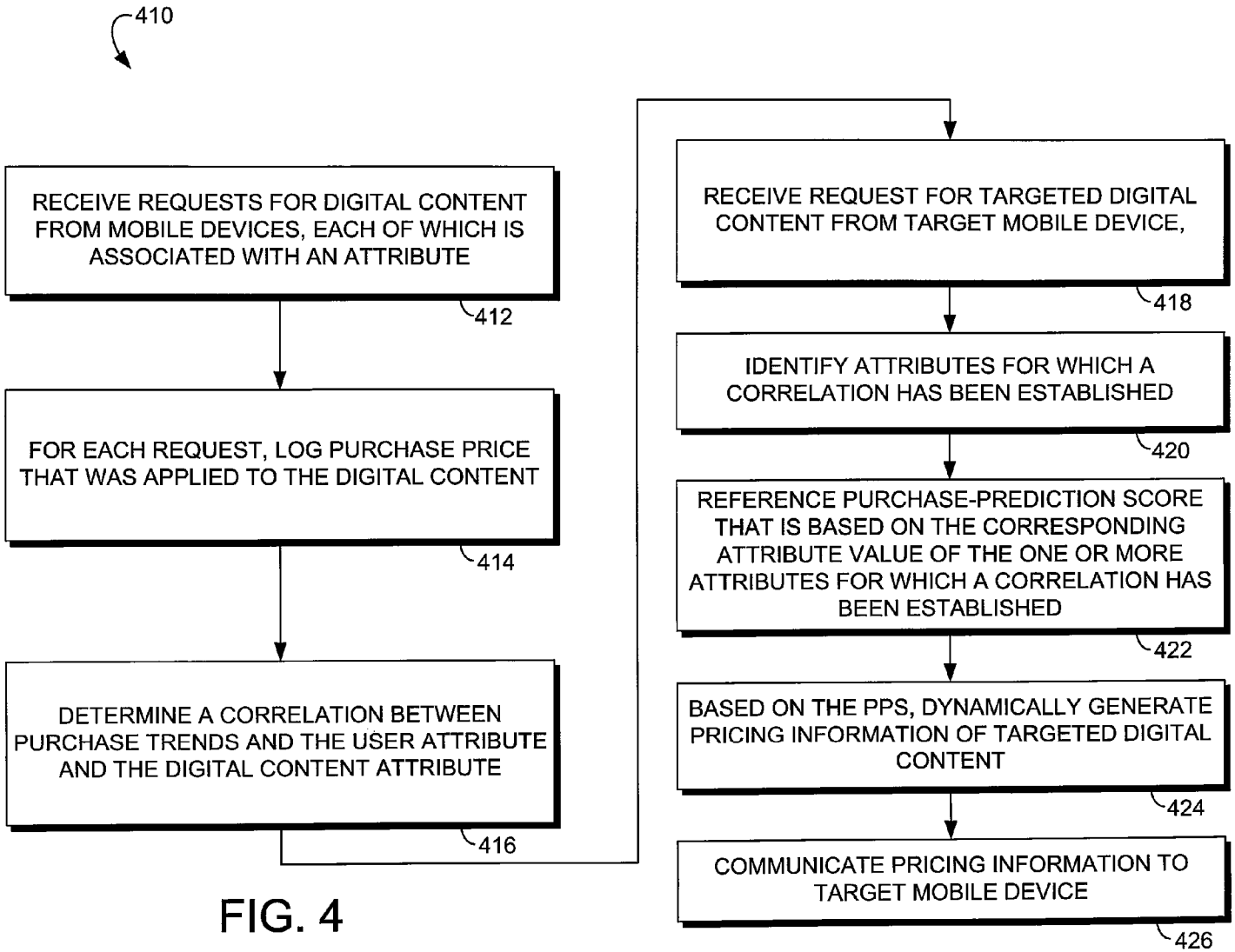
FIGS. 4-6 depict illustrative methods for carrying out embodiments of the present invention.

Referring to FIG. 4, in one embodiment, the technology includes a method (referenced generally by the numeral 410) of dynamically pricing digital content that is retrievable by a target mobile device. The method includes at step 412 receiving requests for digital content from a number of mobile devices, wherein each mobile device is associated with a user attribute and wherein the digital content is associated with a digital content attribute. The method also includes at step 414, for each request, logging a purchase price that was applied to the digital content, wherein the purchase price might be variable from a regular price to a discounted price. Furthermore, the method includes at 416 determining a correlation between purchase trends and at least one of the user attribute and the digital content attribute. Determining a correlation comprises assigning a corresponding attribute value. Moreover, a request for targeted content is received at 418 from the target mobile device. At least one of the targeted digital content and target mobile device is associated with an attribute for which a correlation has been established. The method includes at step 420 identifying the attribute for which a correlation has been established and referencing at 422 a PPS. The PPS is based on the corresponding attribute value of the attribute for which a correlation has been established. Based on the PPS, pricing information of the targeted digital content is dynamically generated at 424 and communicated at 426 to the target mobile device.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. Non-transitory computer-readable media storing computer-useable instructions for performing a method of dynamically pricing digital content that is retrievable by a mobile device, the method comprising:

receiving from said mobile device a request for said digital content, the request including a mobile-device identifier;

referencing a user profile that is matched to the mobile-device identifier, wherein the user profile lists a user attribute that is quantified by a user-attribute value;

determining that the user-attribute value is outside a range of user-attribute values;

in response to determining that the user-attribute value is outside the range, equating a purchase-prediction score (PPS) to the user-attribute value;

based on said PPS, dynamically generating pricing information of said digital content; and communicating said pricing information to said mobile device.

2. The media of claim 1, wherein the user profile lists a plurality of user-attribute values, each user-attribute value of the plurality of user-attribute values quantifying a respective user attribute.

3. Non-transitory computer-readable media storing computer-useable instructions for performing a method of dynamically pricing digital content that is retrievable by a mobile device, the method comprising:

receiving from said mobile device a request for said digital content, the request including a mobile-device identifier;

referencing a user profile that is matched to the mobile-device identifier, wherein the user profile lists a user attribute that is quantified by a user-attribute value;

calculating in real time a purchase-prediction score (PPS) based at least in part on the user-attribute value;

dynamically generating a purchase price of said digital content, wherein the purchase price is equal to a regular purchase price when the PPS is above a range of threshold purchase-prediction scores, wherein the purchase price is equal to a medium purchase price, which is less than the regular purchase price, when the PPS is within the range of threshold purchase-prediction scores; and wherein the purchase price is equal to a low purchase price, which is less than the medium purchase price, when the PPS is below the range of threshold purchase-prediction scores; and communicating said pricing information to said mobile device.

4. The media of claim 3, wherein the user attribute is a device type embodied by the mobile device and the user-attribute value is a device-type attribute value, such that the PPS and the purchase price are based on the device type.

5. The media of claim 3, wherein the method further comprises:

determining that the user-attribute value is not within a range of user-attribute values, and in response to determining that the user-attribute value is not within the range, equating the PPS to the user-attribute value.

6. A method of dynamically pricing digital content that is retrievable by a mobile device, the method comprising:

receiving from said mobile device a request for said digital content, the request including a mobile-device identifier;

referencing in a datastore a user profile that is matched to the mobile-device identifier, wherein the user profile lists a user attribute that is quantified by a user-attribute value;

determining that the user-attribute value is outside a range of user-attribute values;

in response to determining that the user-attribute value is outside the range, equating a purchase-prediction score (PPS) to the user-attribute value;

based on said PPS, dynamically generating, by a computing device, pricing information of said digital content; and communicating said pricing information to said mobile device.

7. The method of claim 6, wherein the user profile lists a plurality of user-attribute values, each user-attribute value of the plurality of user-attribute values quantifying a respective user attribute.

* * * * *